United States Patent [19]

Oshita et al.

[11] 4,399,390

[45] Aug. 16, 1983

[54] BUILT-IN STARTER TYPE FLUORESCENT LAMP SOCKET

[75] Inventors: Hiroshi Oshita; Hiromi Adachi; Kazunari Inoue, all of Kamakura, Japan

[73] Assignee: Mitsubishi Denki Kabushiki Kaisha, Tokyo, Japan

[21] Appl. No.: 215,769

[22] Filed: Dec. 12, 1980

[30] Foreign Application Priority Data

Dec. 18, 1979 [JP] Japan ..... 54-164585

[51] Int. Cl.[3] ..... H05B 41/04; H01R 33/08

[52] U.S. Cl. ..... 315/101; 315/DIG. 5; 339/50 C; 339/51; 339/103 R

[58] Field of Search ..... 315/94, 99–101, 315/105, 106, 289, 290, DIG. 5; 339/17 D, 51, 144 R, 50 C, 103 R, 103 C, 107, 278 L; 307/157; 337/22

[56] References Cited

U.S. PATENT DOCUMENTS 2,507,898 5/1950 Gaynor et al. ..... 337/22
4,119,886 10/1978 Jyomura et al. ..... 315/101
4,204,139 5/1980 Shimer et al. ..... 315/DIG. 5

*Primary Examiner*—Eugene R. LaRoche

*Attorney, Agent, or Firm*—Sughrue, Mion, Zinn, Macpeak, and Seas

[57] ABSTRACT

A built-in starter type fluorescent lamp socket in which the starter is entirely incorporated with the socket with no protruding parts and in which it is not necessary to replace the starter. The socket includes a socket body, pairs of starter contacts and power source contacts operatively positioned in the socket body for making connection with fluorescent lamp pins, and an electronic starter positioned in the socket body and connected to the starter contacts. The electronic starter includes a non-linear dielectric element and a thyristor coupled in parallel and across the starter contacts. The anode of the thyristor is coupled through a Zener diode to the common connection point between voltage division resistors also coupled across the starter contacts. The socket body may include a casing having lamp pin inserting holes and a cover for covering the rear side of the casing wherein the cover may be shaped in the form of a box in which the electronic starter is mounted. In a preferred embodiment, the casing is provided with a lead wire receiving portion which together with the cover clamp the lead wires which are connected to the power source contacts.

5 Claims, 4 Drawing Figures

BUILT-IN STARTER TYPE FLUORESCENT LAMP SOCKET

BACKGROUND OF THE INVENTION

The present invention relates to an improved annular fluorescent lamp socket incorporating a starter.

Annular fluorescent lamp sockets (hereinafter referred to merely as "sockets" when applicable) provided integrally with a glow starter have previously been known in the art. In the conventional socket, it is necessary to provide the socket of the glow starter in the socket body itself. This makes the socket body necessarily intricate in construction. Since the glow starter is bulky, it is difficult to miniaturize the socket. Furthermore, the service life of the glow starter is relatively short and therefore it is often necessary to replace it. Because of the starting characteristics of the glow starter, it is required to externally apply light to the glow starter making it necessary that a part of the glow starter protrude from the socket body. Accordingly, the conventional socket suffers from problems that the socket has a poor external appearance and the glow starter can easily be damaged when the fluorescent lamp is replaced.

An annular fluorescent lamp socket has been previously proposed in which, instead of the glow starter, an electronic starter is incorporated in the socket body. In the electronic starter, a high voltage pulse necessary for starting the fluorescent lamp is generated by a ferrite core type pulse transformer coupled to a semiconductor switch. However, that socket has not been put to commercial use because the pulse transformer is considerably bulky and its lamp lighting circuit is intricate with the result that it is difficult to miniaturize the socket and the socket is expensive.

SUMMARY OF THE INVENTION

In view of the foregoing, an object of the present invention is to provide a built-in starter type fluorescent lamp socket which is simple in construction, small in size and excellent in external appearance and in which the starter need not be replaced.

In accordance with this and other objects of the invention there is provided a fluorescent lamp socket in which a conventional fluorescent lamp socket is formed integrally with an electronic starter which is adapted to provide a high voltage pulse necessary for starting the fluorescent lamp utilizing a non-linear dielectric element having a non-linear voltage-current characteristic and a semiconductor switch.

More specifically, this and other objects of the invention are met by a built-in starter type fluorescent lamp socket including a socket body, a pair of starter and pair of power source contacts operatively positioned in the socket body adapted to make connection with lamp pins, and an electronic starter incorporated in the socket body connected to the starter contacts. The electronic starter includes pulse generating means including a non-linear dielectric element. The socket body may include a casing having lamp pin inserting holes corresponding to the positions of the power source and starter contacts and a cover adapted for covering the rear side of the casing. The casing may be formed in the shape of a box in which the electronic starter is mounted. The casing may be provided with a lead wire receiving portion which together with the cover clamps the lead wires which are connected to the power source contacts. Preferably, the electronic starter includes a dielectric element having a non-linear voltage-current characteristic coupled across the starter contacts in parallel with a thyristor and series-coupled voltage division resistors. A Zener diode is coupled between the common connection point of the voltage division resistors and the anode of the thyristor.

DESCRIPTION OF THE PREFERRED EMBODIMENTS

Figure 1:
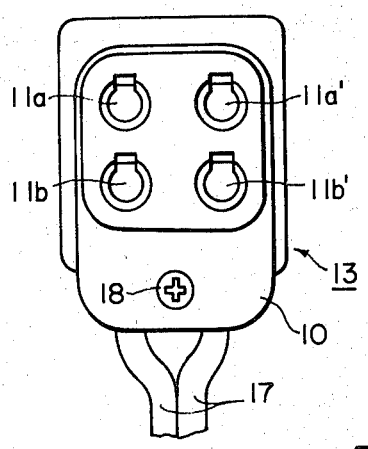
FIG. 1 is a front view of a preferred embodiment of a built-in starter type fluorescent lamp socket according to the invention.

A preferred embodiment of a built-in starter type fluorescent lamp socket constructed according to the invention will be described with reference to FIGS. 1 through 3.

A casing 10 made of urea resin is provided with four lamp inserting holes 11*a*, 11*a'*, 11*b* and 11*b'* which are formed at positions corresponding to the positions of the pins of a fluorescent lamp with the holes extending through from the front side to the rear side of the casing 10. The casing 10 is formed with a lead wire receiving portion 19 on the rear side thereof which diverges in the form of a flange forming a rise portion 20 at the periphery of the rear side.

The rear side of the casing 10 is covered with a box-bottom shaped cover 12 which is also made of urea resin. More specifically, the cover 12 is fixedly secured to the lead wire receiving portion 19 of the casing 10 with a screw 18. The casing 10 and the cover 12 thus form a socket body 13 the size of which is substantially equal to the size of a conventional fluorescent lamp socket which incorporates no glow starter.

A pair of starter contacts 14*a* are fixedly fitted in the lamp in inserting holes 11*a* and 11*a'* and a pair of power source contacts 14*b* are similarly fixedly fitted in the remaining holes 11*b* and 11*b'*. The contacts 14*a* and 14*b* are made of electrically conductive spring material.

The socket body 13 incorporates an electronic starter 15. The electronic starter 15 may be a known type such as shown in FIG. 3 and ispreferably provided as a hybrid integrated circuit including a dielectric element 15*a* having a non-linear voltage-current characteristic and a semiconductor switch 15*b* constituted by a three-electrode thyristor $15b_1$, a Zener or trigger diode $15b_2$ and voltage division resistors $15b_3$ and $15b_4$. The electronic starter 15 is connected through a pair of lead wires 16 to the rear ends of the starter contacts 14*a* and 14*a'* respectively.

Figure 2:
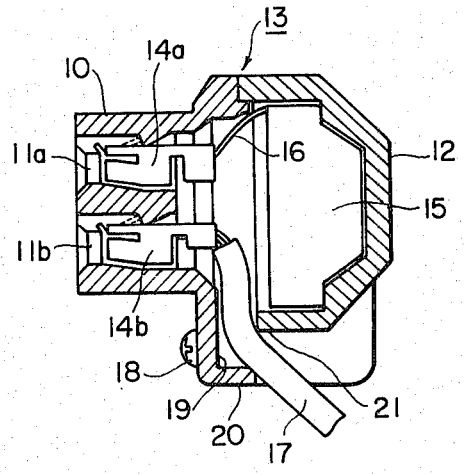
FIG. 2 is a sectional view of the fluorescent lamp socket shown in FIG. 1.
Figure 3:
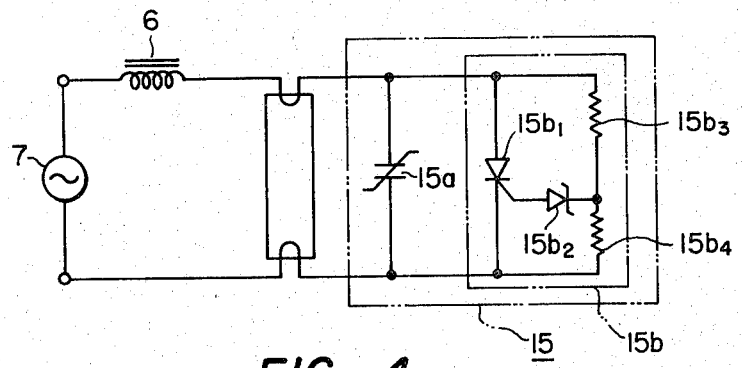
FIG. 3 PRIOR ART
FIG. 3 is a circuit diagram showing a fluorescent lamp lighting circuit which is formed with the fluorescent lamp socket shown in FIGS. 1 and 2.

In FIGS. 1 and 2, reference numeral 17 designates a pair of lead wires first ends of which are clamped to the rear ends of the power source contacts 14*b*. A portion of the lead wires 17 is held between a lead wire receiving portion 19 of the casing 10 and the edge 21 of the cover 12. The other ends of the lead wires 17 extend outside the socket body 13 and are connected to the power source 7.

As can be appreciated from the above description, the electronic starter 15 is wholly incorporated with the lamp socket. The lamp lighting circuit is completed by connecting the pair of lead wires 17 to a ballast 6 and the power source 7. With this device, the number of connections which need be made to the illuminating appliance is only two which makes the installation of an illuminating appliance employing the invention very simple. In addition, it is unnecessary to provide a glow starter and a starter socket for mounting the glow starter. Accordingly, it is possible to make the construction of the socket body considerably simple.

The service life of the electronic starter 15 is extremely long and hence it is unnecessary to replace it for a long period of time. Furthermore, since it is built into the socket body 13, it is protected from damage which otherwise may be caused by an external force. As described above, the electronic starter is provided as a hybrid integrated circuit including the non-linear dielectric element 15*a* and the semiconductor switch 15*b*. Therefore, the electronic starter 15 is small in size. More specifically, the size of the electronic starter 15 is substantially equal to the size of the conventional fluorescent lamp socket in which no glow starter is built.

The lead wires 17 are held by the lead wire receiving portion 19 and the edge 21 of the cover 12. Therefore, even when tension is applied to the lead wires 17, the contacts are not affected and the lead wires 17 cannot be pulled loose. The pair of lead wires 17 is directed at an angle of about 45° with respect to the socket mounting direction by the rise portion 20 of the casing 10. Accordingly, the fluorescent lamp can be connected to the socket with the lead wires 17 directed away from the fluorescent lamp pins.

Figure 4:
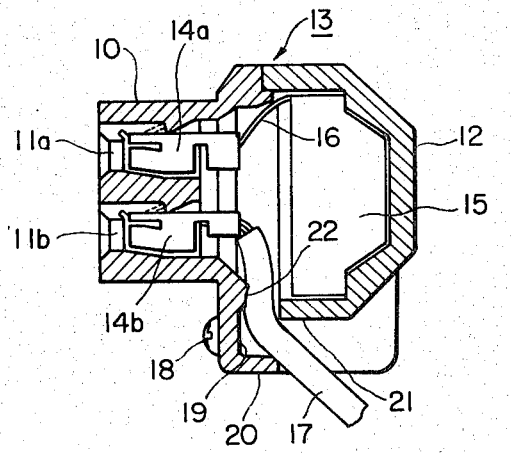
FIG. 4 is a sectional view of another preferred embodiment of a fluorescent lamp socket according to the invention.

Another embodiment of a built-in starter type fluorescent lamp socket according to the invention is shown in FIG. 4. The fluorescent lamp socket of this embodiment is formed by providing a protrusion 22 for the lead wire receiving portion 19 in the embodiment shown in FIGS. 1 and 2. The provision of the protrusion 22 is intended to more positively hold the lead wires 17.

In the above-described embodiments, the electronic starter 15 is mounted within the cover 12. This simplifies the assembly of the fluorescent lamp socket. That is, in the assembling of the socket, first the lead wires 17 are connected to the power source contacts 14*b* in the casing 10 after which the electronic starter 15 whose lead wires 16 have been connected to the starter contacts 14*a* and 14*a*40 is mounted in the cover 12. Thereafter, the casing 10 and the cover 12 are fixedly assembled.

The above-described socket may be modified by providing a space in the casing 10 for incorporating the electronic starter 15 with the casing closed with a plate-shaped cover 12. Alternatively, the socket body 13 may be integrally formed with the contacts 14*a*, 14*a'*, 14*b* and 14*b'*, the electronic starter 15 and the lead wires 17 built therein without separating the socket body 13 into the casing 10 and the cover 12. If necessary, a noise preventing capacitor can be incorporated in the socket body 13.

With the fluorescent lamp socket constructed as described above, it is unnecessary to provide a glow starter and a glow starter socket. In addition, the socket of the invention is small in size and in fact it can be manufactured with a size substantially that of a conventional fluorescent lamp socket in which one glow starter is incorporated.

In the fluorescent lamp socket of the invention, the starter does not protrude from the socket body. Therefore, the starter is protected from damage. Furthermore, the electronic starter is semipermanent in service life and therefore it is unnecessary to replace it. In addition, the time required for lighting the fluorescent lamp is short.

What is claimed is:

1. A built-in starter type fluorescent lamp socket, comprising:

a socket body including a casing and a cover portion;

a pair of starter contacts and a pair of power source contacts embedded in said casing; and power leads coupled to said power contacts at the interior of said socket body and extending to the exterior thereof, said casing and cover portion clamping said power leads therebetween.

2. A lamp socket as defined in claim 1, wherein said casing and cover portion define a path between the interior and exterior of said socket which does not allow a straight line, said power leads being confined to said path.

3. A lamp socket as defined in claims 1 or 2, wherein said casing portion includes a clamping surface facing toward said cover portion, said cover portion includes an edge facing toward said clamping surface, and said clamping surface is provided with a protrusion thereon which extends in the direction of said cover portion and is offset from said edge along the path of said leads, said power leads being clamped between said edge and protrusion.

4. A lamp socket as defined in claims 1 or 2, wherein said starter and power source contacts extend in a mounting direction, said power leads extending to the exterior of said socket body at a predetermined non-zero angle with respect to said mounting direction.

5. A lamp socket as defined in claim 4, wherein said predetermined angle is substantially 45°.

* * * * *